US006619057B2

(12) United States Patent
Williamson et al.

(10) Patent No.: US 6,619,057 B2
(45) Date of Patent: Sep. 16, 2003

(54) SYSTEM AND METHOD FOR LOW SIDE PUMP DOWN IN MOBILE REFRIGERATION UNIT

(75) Inventors: Willard Edwin Williamson, Syracuse, NY (US); Paul Valentine Weyna, Manlius, NY (US); Richard Alan Simone, Baldwinsville, NY (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 10/015,510

(22) Filed: Dec. 13, 2001

(65) Prior Publication Data

US 2003/0110785 A1 Jun. 19, 2003

(51) Int. Cl.[7] ..... F25B 45/00
(52) U.S. Cl. ..... 62/149; 62/292
(58) Field of Search ..... 62/149, 292

(56) References Cited

U.S. PATENT DOCUMENTS

| | | | | | |
|---|---|---|---|---|---|
| 3,873,289 | A | * | 3/1975 | White | 62/149 |
| 4,441,330 | A | * | 4/1984 | Lower et al. | 62/149 |
| 4,624,112 | A | * | 11/1986 | Proctor | 62/149 |
| 4,755,957 | A | * | 7/1988 | White et al. | 62/126 |
| 5,361,592 | A | * | 11/1994 | Lewis | 62/86 |
| 5,423,190 | A | * | 6/1995 | Friedland | 62/149 |
| 6,134,896 | A | * | 10/2000 | Brown et al. | 62/149 |
| 6,138,462 | A | * | 10/2000 | Murray et al. | 62/149 |
| 6,202,433 | B1 | * | 3/2001 | Murray et al. | 62/149 |

* cited by examiner

*Primary Examiner*—William C. Doerrler
*Assistant Examiner*—Filip Zec
(74) *Attorney, Agent, or Firm*—Wall Marjama & Bilinski LLP

(57) ABSTRACT

A microprocessor controlled system performs low pressure side pumpdown with the assistance of a service technician. When the refrigerant in the system is transferred to the high pressure side, the low pressure side is available for servicing by the technician.

15 Claims, 5 Drawing Sheets

SYSTEM AND METHOD FOR LOW SIDE PUMP DOWN IN MOBILE REFRIGERATION UNIT

FIELD OF THE INVENTION

This invention relates generally to the field of mobile refrigeration units, and more particularly to a mobile refrigeration unit that undergoes a process whereby a service technician can service the low pressure side.

BACKGROUND OF THE INVENTION

The purpose of a low side pump down is to provide service technicians with an opportunity to service the low pressure side of a mobile refrigeration system. Examples of the types of service which can be performed include replacing the filter dryer, replacing or servicing the electronic expansion valve, the electronic modulation valve, the compressor suction pressure transducer, and the compressor suction temperature thermistor. Service can be performed after the refrigerant is removed from the system, which is a costly and lengthy process. Alternately, the service technician can engage in a tedious manual process, consisting of attaching gauges to the system at appropriate locations, closing the shut-off valve, watching the suction pressure, shutting off the unit when a specified low suction pressure is achieved, watching the gauges again to monitor the suction pressure, and if the suction pressure begins to rise, running through the process again. Eventually, the technician is able to service the low pressure side.

SUMMARY OF THE INVENTION

Briefly stated, a microprocessor controlled system performs low pressure side pumpdown with the assistance of a service technician. When the refrigerant in the system is transferred to the high pressure side, the low pressure side is available for servicing by the technician.

According to an embodiment of the invention, an apparatus for low pressure side pumpdown processing of refrigerant in a mobile refrigeration unit includes a compressor; an engine which powers the compressor; a microprocessor connected to the engine and to a plurality of valves and sensors in the unit; means, responsive to the microprocessor, for minimizing an amount of refrigerant mixed with oil in the compressor; and transferring means, responsive to input from a user, for transferring substantially all of the refrigerant from a low pressure side of the unit to a receiver.

According to an embodiment of the invention, a method for low pressure side pumpdown processing of refrigerant in a mobile refrigeration unit includes the steps of providing a microprocessor connected to a plurality of valves; providing a compressor for the unit; minimizing an amount of the refrigerant mixed with oil in the compressor; opening and closing specified ones of the plurality of valves; running, in response to the microprocessor, a compressor to pump refrigerant in the unit into a receiver; monitoring a suction pressure and providing results of the monitoring to the microprocessor; shutting down the compressor, in response to the microprocessor, after the suction pressure falls below a first predetermined point; opening, in response to the microprocessor, an electronic evaporator expansion valve and monitoring the suction pressure to see if the suction pressure remains below a second predetermined point; signaling the microprocessor to resume normal operation; and opening and closing, in response to the microprocessor, specified ones of the plurality of valves to return the unit to normal operation.

DETAILED DESCRIPTION OF THE PREFERRED EMBODIMENT

Figure 1:
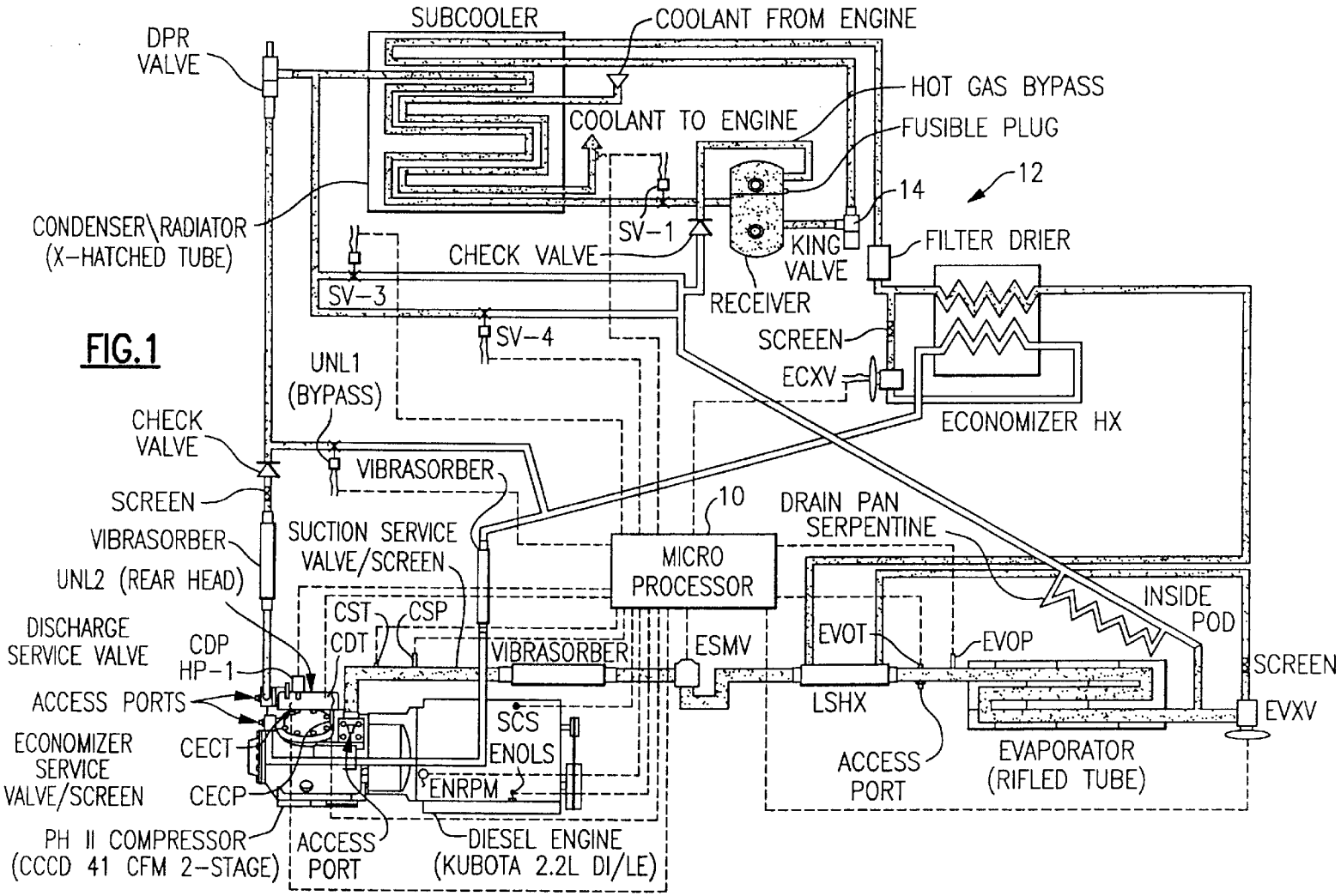
FIG. 1 shows a system schematic of a mobile refrigeration unit.

Referring to FIG. 1, a system schematic of a mobile refrigeration unit 12 is shown. Mobile units use the same conventional refrigeration cycle as other units, but with modifications that provide greater cooling capacity with a smaller physical structure than is generally obtained in stationary units. The following abbreviations are used in FIG. 1.

| | |
|---|---|
| DPR | discharge pressure regulator |
| SV | solenoid valve |
| ECXV | economizer expansion valve |
| HX | heat exchanger |
| UNL | unloader |
| CDP | compressor discharge pressure |
| HP | high pressure switch |
| CDT | compressor discharge temperature |
| CST | compressor suction temperature |
| CSP | compressor suction pressure |
| CECT | compressor economizer temperature |
| CECP | compressor economizer pressure |
| ESMV | electronic suction modulation valve |
| LSHX | liquid to suction heat exchanger |
| EVOT | evaporator outlet temperature |
| EVOP | evaporator outlet pressure |
| EVXV | evaporator expansion valve |
| ENRPM | engine RPM |
| ENOLS | engine oil level switch |
| SCS | speed control solenoid |

The various sensors and valves of unit 12 are connected to a microprocessor 10. The method of the invention is generally as follows. The engine is run to warm up the compressor and refrigeration system. The purpose of the warm up period is to bring all components up to normal operating temperature, and to minimize the amount of refrigerant in the compressor oil. After the warm up phase, the service technician is preferably prompted to close a shut-off valve 14, termed a "King valve" by United Technologies Carrier Transicold. The engine is restarted and the pump down process begins. During the pump down process, all system valves are preferably controlled by microprocessor 10 in order to evacuate the refrigerant from the low pressure side of the refrigeration system and store it on the high pressure side of the refrigeration system. When the compressor suction pressure CSP drops below a preset threshold, the engine shuts off. The suction pressure is then monitored for a preset hold time. If the suction pressure rises above a threshold during the hold time, the engine restarts and the process is repeated. The process can repeat for a preset number of pump down times. If the unit fails to hold suction pressure during all of the pump downs, an error is indicated to the technician.

Figure 2:
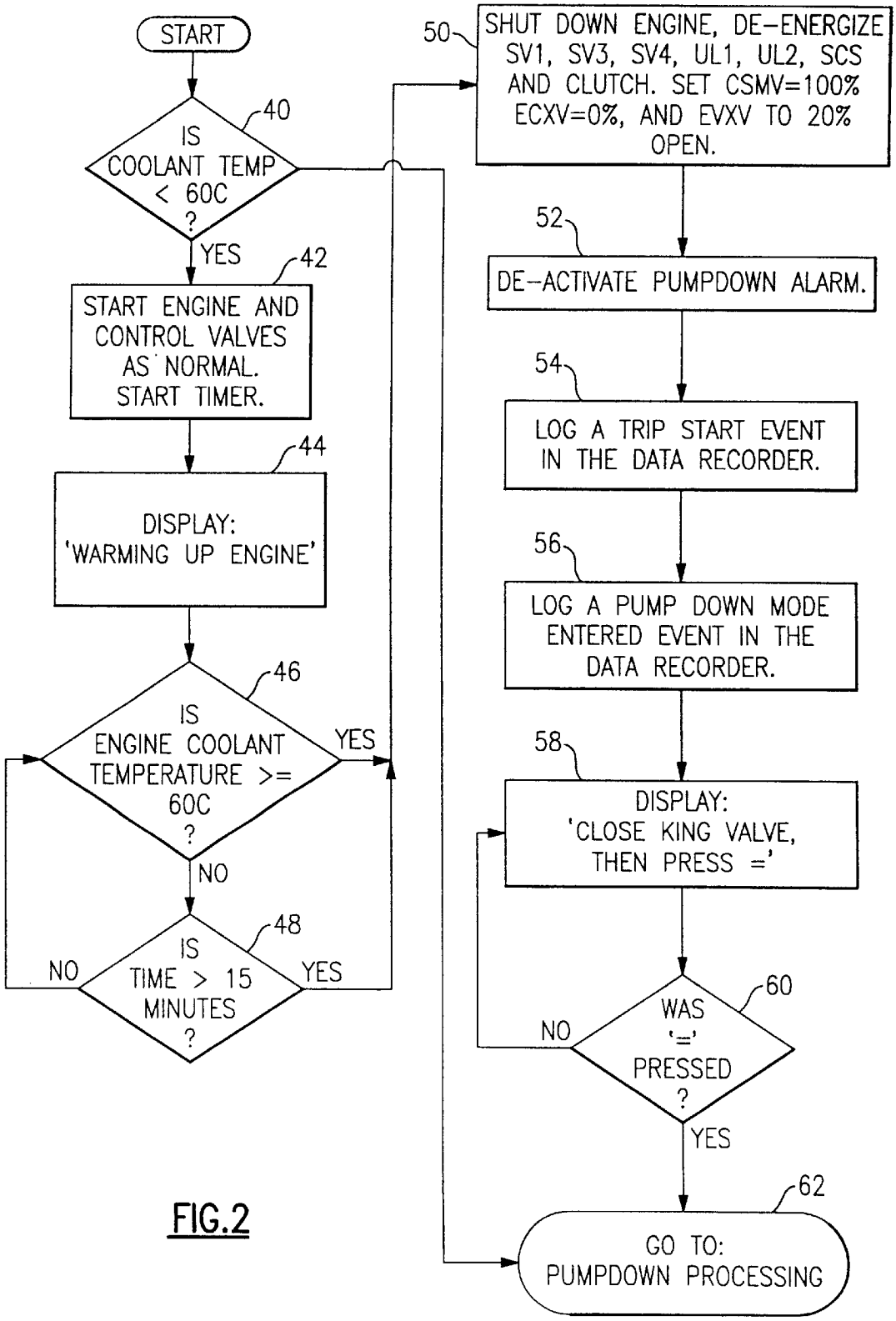
FIG. 2 shows a flow chart of a system warm up stage according to an embodiment of the invention.

Referring now to FIG. 2, the method of the invention is described in greater detail. The coolant temperature is checked in step 40, and if the coolant temperature is less than 60 degrees C. the engine is started in step 42. "WARMING UP ENGINE" is preferably displayed to the service technician in step 44. All valves and unloaders are controlled in normal fashion. The engine is run until the coolant temperature is greater than or equal to 60 degrees C. (step 46), but no longer than 15 minutes (step 48). The engine is shut down in step 50. Valves SV-1 (normally energized to close), SV-3 (normally energized to open), SV-4 (normally energized to open), UNL-1 (normally energized to unload), UNL-2 (normally energized to unload), and SCS are de-energized. Expansion valves are set with the values ECXV=0%, CSMV=100%, 21 and EVXV=20% open. The pumpdown alarm is deactivated in step 52. A trip start event is preferably logged in the data recorder in step 54. A "pump down mode entered" event is preferably logged in the data recorder in step 56. "CLOSE KING VALVE, THEN PRESS=" is preferably displayed in step 58. The system checks to see if "=" is pressed in step 60, and if so, control passes to pumpdown processing in step 62. If, in step 40, the coolant is at or greater than 60 degrees C., control passes directly to step 62.

Figures 3, 3A:
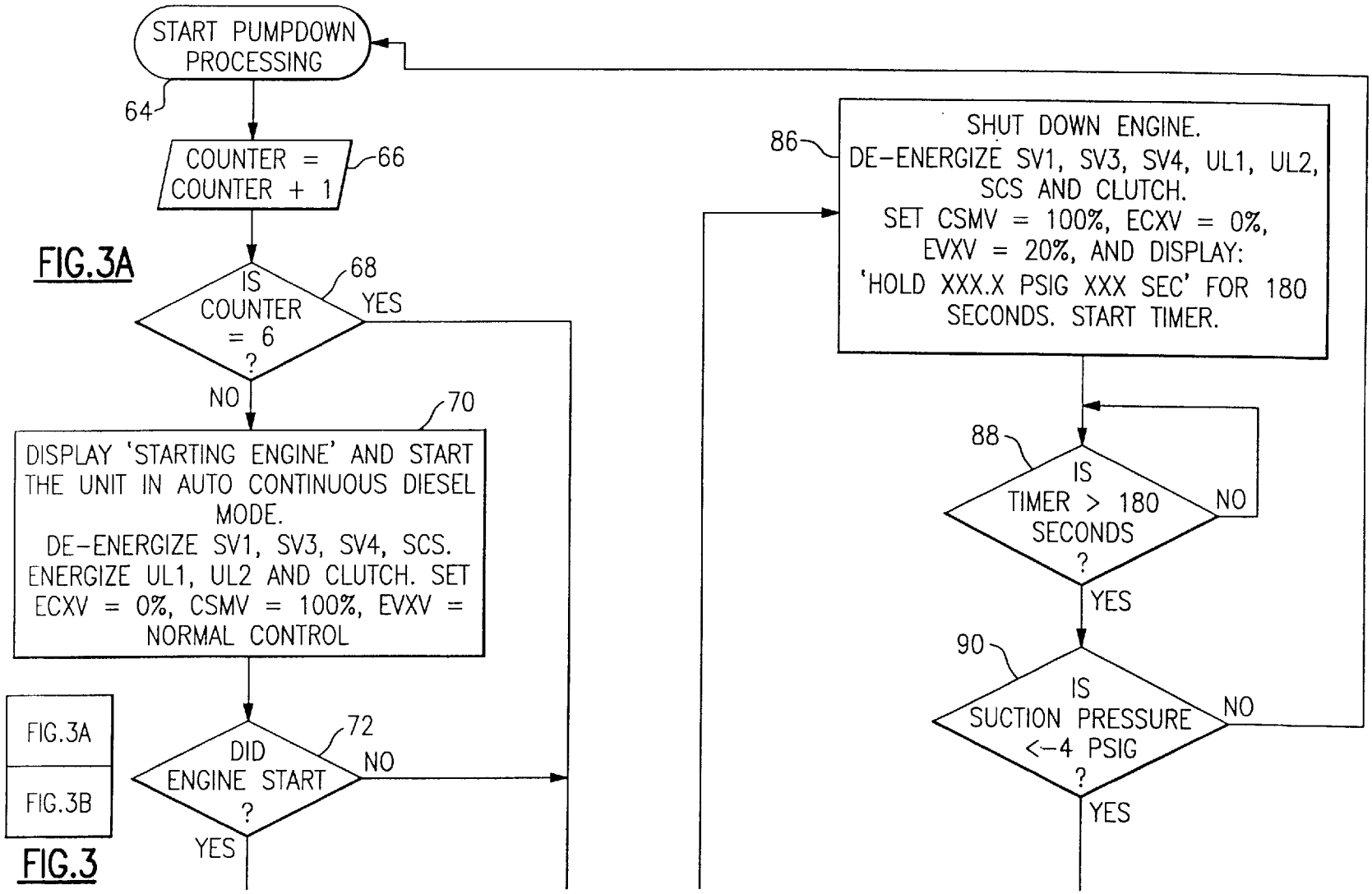
FIG. 3 shows a flow chart of a pump-down processing stage according to an embodiment of the invention.
Figure 3B:
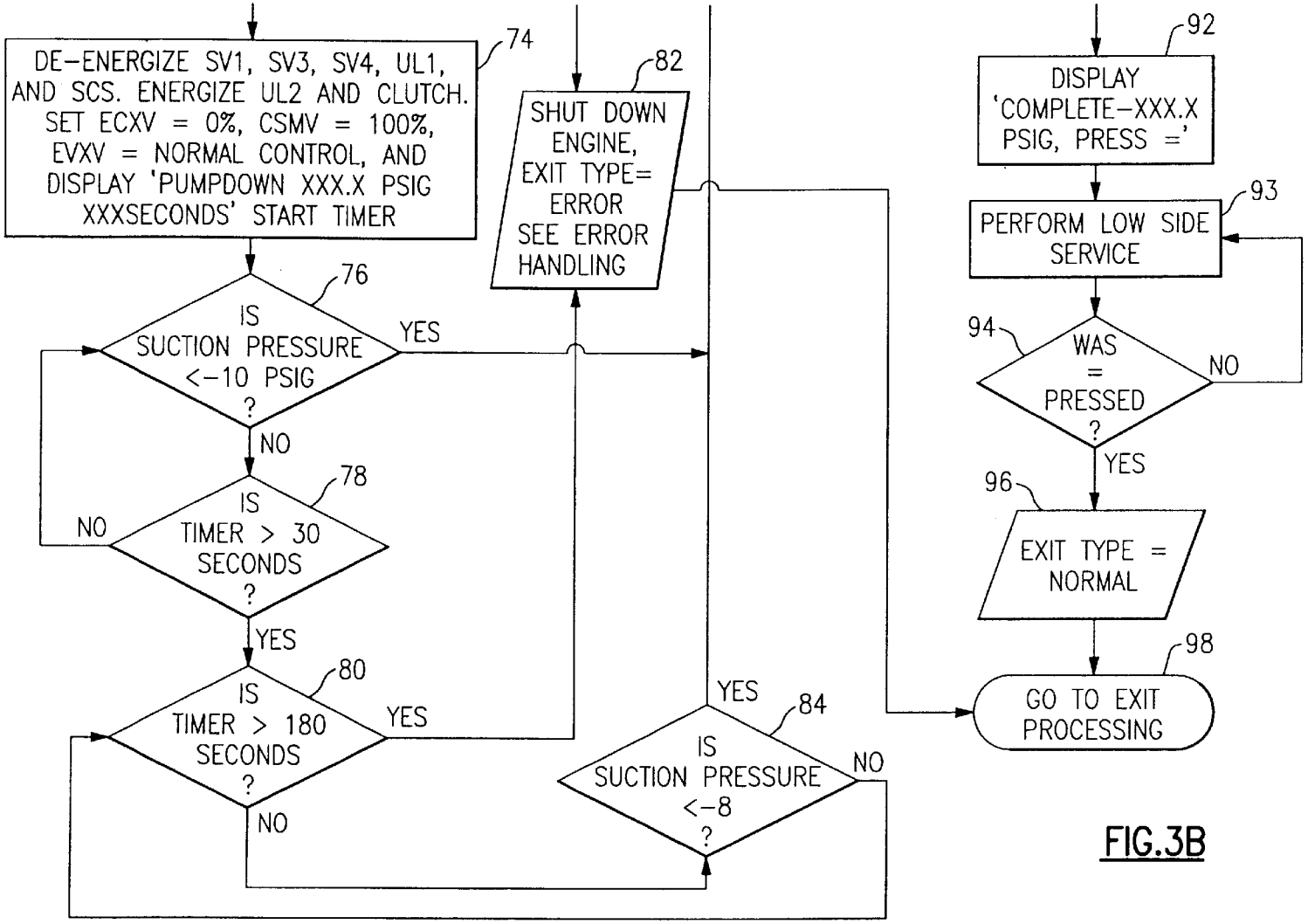

Referring to FIG. 3, pumpdown processing is started in step 64. The number of times that pumpdown processing is started is kept track of in step 66. In step 68, if this is the 6th attempt at pumpdown processing, the exit type is set to "Error" and control passes to an error handling subroutine at step 82. If fewer than 6 attempts at pumpdown processing have occurred, the engine is started in step 70. "STARTING ENGINE" is preferably displayed. SV-1, SV-3, SV-4, and SCS are de-energized, while UNL-1, UNL-2, and the clutch are energized. Expansion valves are set as ECXV=0%, CSMV=100%, and EVXV=normal control. In step 72, the engine is checked to see if it started. If not, the exit type is set to "Error" and control passes to the error handling subroutine at step 82. If the engine started, then SV-1, SV-3, SV-4, UNL-1, and SCS are de-energized in step 74. UNL-2 and the clutch are energized. Expansion valves are set as ECXV=0%, CSMV=100%, and EVXV=normal control. "PUMPDOWN XXX.X PSIG XXXSECONDS" is preferably displayed and a timer is started.

If the suction pressure is less than −10 psig in step 76, step 86 is invoked and the engine is stopped. Otherwise, the timer is checked in step 78 to see if 30 seconds has elapsed. If not, control reverts to step 76. In other words, during the first 30 seconds of engine running, the engine is turned off if the suction pressure drops below −10 psig. Then in steps 80 and 84, if the suction pressure doesn't drop below −8 psig during the next 150 seconds, the engine is stopped, the exit type is set to "Error", and the error handling subroutine at step 82 is invoked. If, during the 150 second period, the suction pressure drops below −8 psig, the engine is turned off in step 86. SV-1, SV-3, SV-4, UNL-1, UNL-2, SCS, and the clutch are de-energized. Expansion valves are set as ECXV=0%, CSMV=100%, and EVXV=20% open. "HOLD XXX.X PSIG (or BARS) SXX SEC" is preferably displayed for 180 seconds (step 88). In step 90, if the suction pressure is less than or equal to 4 psig after the 180 seconds expire, the pumpdown processing cycle begins again at step 64. If the suction pressure is less than 4 psig after the 180 seconds, "COMPLETE-XXX.X PSIG (or BARS), PRESS=" is preferably displayed in step 92. The pumpdown is complete, allowing the service technician to perform low side service at step 93. After servicing, the technician presses the "=" key in step 94. The exit type is then set to "Normal" in step 96 and control passes to exit processing in step 98.

Figure 4:
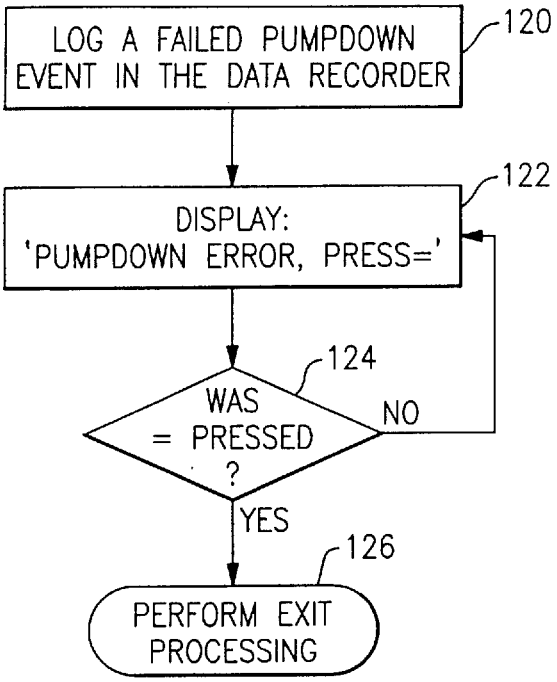
FIG. 4 shows a flow chart of an error handling stage according to an embodiment of the invention.

Referring to FIG. 4, the error handling subroutine begins with logging a failed pumpdown event in the data recorder in step 120. In step 122, "PUMPDOWN ERROR, PRESS=" is preferably displayed. The system waits in step 124 until "=" is pressed, after which step 126 passes control to exit processing. If there are any shutdown alarms, "CLEAR ALARMS" is preferably displayed to the technician.

Figure 5:
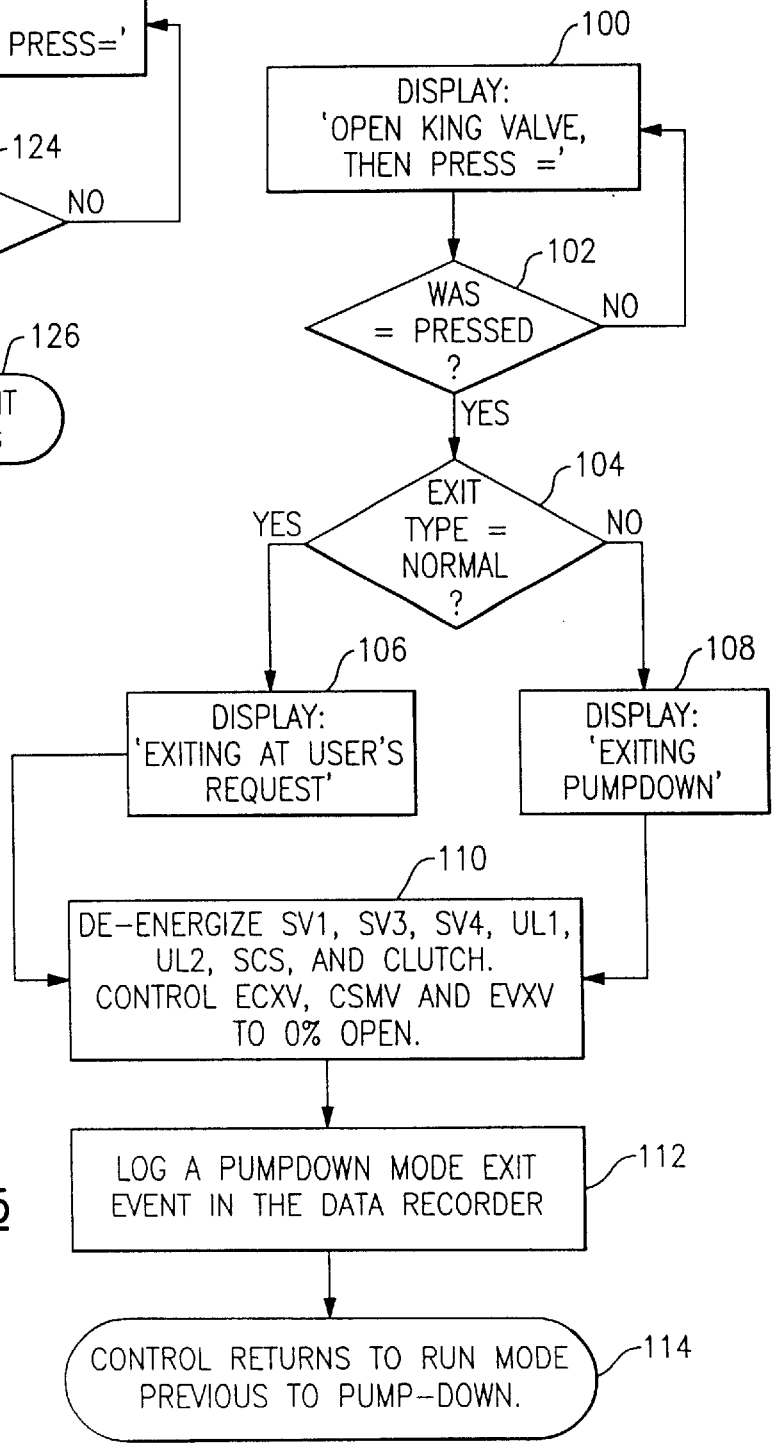
FIG. 5 shows a flow chart of an exit processing stage according to an embodiment of the invention.

Referring to FIG. 5, the exit processing is preferably performed as follows. In step 100, "OPEN KING VALVE, THEN PRESS=" is preferably displayed. When "=" pressed (step 102), the exit type is checked in step 104. If the exit type is normal, "EXITING AT USER'S REQUEST" is preferably displayed in step 106. If not, "EXITING PUMPDOWN" is preferably displayed in step 108. Then, in step 110, SV-1, SV-3, SV-4, UNL-1, UNL-2, SCS, and the clutch are de-energized. Expansion valves are set as ECXV=0%, CSMV=0%, and EVXV=0% open. Once the valves reach 0%, log a "Pumpdown Mode Exit" event in the data recorder in step 112. The unit then returns to the previous run mode in step 114.

While the present invention has been described with reference to a particular preferred embodiment and the accompanying drawings, it will be understood by those skilled in the art that the invention is not limited to the preferred embodiment and that various modifications and the like could be made thereto without departing from the scope of the invention as defined in the following claims.

What is claimed is:

1. An apparatus for low pressure side pumpdown processing of refrigerant in a mobile refrigeration unit, comprising:

a compressor;

an engine which powers said compressor;

a microprocessor connected to said engine and to a plurality of valves and sensors in said unit; and transferring means, responsive to input from a user, for transferring substantially all of said refrigerant from a low pressure side of said unit to a receiver in a high pressure side of said unit.

2. An apparatus according to claim 1, further comprising display means for displaying at least one message to said user.

3. An apparatus according to claim 2, wherein said display means is responsive to said microprocessor.

4. An apparatus according to claim 2, wherein said at least one message is responsive to input received by said microprocessor.

5. An apparatus according to claim 1, wherein said transferring means includes said user closing a shut-off valve and said input from said user includes signaling said microprocessor that said shut-off valve is closed.

6. An apparatus according to claim 5, wherein said transferring means includes means for monitoring a suction pressure of said unit while said engine is on, and means for turning said engine off when said suction pressure falls below a first specified threshold.

7. An apparatus according to claim 6, wherein said transferring means further includes means for monitoring said suction pressure after said engine is turned off, and means for turning said engine on if said suction pressure rises past a second specified threshold.

8. An apparatus according to claim 7, further comprising display means for displaying at least one message to said user.

9. An apparatus according to claim 8, wherein said display means is responsive to said microprocessor.

10. An apparatus according to claim 9, wherein said display means signals said user that said unit is ready for low pressure side maintenance.

11. An apparatus according to claim 10, wherein said user signals said microprocessor that said unit should be returned to normal operation.

12. An apparatus according to claim 11, wherein said display means signals said user to open said shut-off valve.

13. An apparatus according to claim 12, wherein said user signals said microprocessor that said shut-off valve is closed.

14. A method for low pressure side pumpdown processing of refrigerant in a mobile refrigeration unit, comprising the steps of:

providing a microprocessor connected to a plurality of valves;

providing a compressor for said unit;

opening and closing specified ones of said plurality of valves;

running, in response to said microprocessor, a compressor to pump refrigerant in a low pressure side of said unit into a receiver in a high pressure side of said unit;

monitoring a suction pressure and providing results of said monitoring to said microprocessor;

shutting down said compressor, in response to said microprocessor, after said suction pressure falls below a first predetermined point;

opening, in response to said microprocessor, an electronic evaporator expansion valve and monitoring said suction pressure to see if said suction pressure remains below a second predetermined point;

signaling said microprocessor to resume normal operation; and opening and closing, in response to said microprocessor, specified ones of said plurality of valves to return said unit to normal operation.

15. A method according to claim 14, further comprising the steps of:

displaying at least one message to a user; and receiving input from said user in response to said step of displaying.

* * * * *